US005297326A

United States Patent [19]

Kline

[11] Patent Number: 5,297,326

[45] Date of Patent: Mar. 29, 1994

[54] METHOD AND APPARATUS FOR CONVERTING A FIXED-OPENING AIR DIFFUSER TO AN INDIVIDUALLY-CONTROLLED VARIABLE AIR VOLUME DIFFUSER

[75] Inventor: James R. Kline, Moraga, Calif.

[73] Assignee: Acutherm Limited, Hayward, Calif.

[21] Appl. No.: 53,099

[22] Filed: Apr. 26, 1993

[51] Int. Cl.[5] ..... F24F 13/14

[52] U.S. Cl. ..... 29/401.1; 236/49.5; 454/292; 454/304

[58] Field of Search ..... 236/49.5; 454/258, 292, 454/302, 304; 29/401.1

[56] References Cited

U.S. PATENT DOCUMENTS

| | | | |
|---|---|---|---|
| Re. 30,953 | 6/1982 | Vance et al. | 236/49 |
| 4,491,270 | 1/1985 | Brand | 236/49 |
| 4,509,678 | 4/1985 | Noll | 236/49 |
| 4,523,713 | 1/1985 | Kline et al. | 236/49 |

OTHER PUBLICATIONS

THERMA-FUSER © I, Thermally Powered VAV Diffuser brochure published in 1981.

*Primary Examiner*—William E. Tapoicai

*Attorney, Agent, or Firm*—Flehr, Hohbach, Test, Albritton & Herbert

[57] ABSTRACT

An apparatus and method for converting a fixed-opening air diffuser (21) to an individually-controlled variable air volume diffuser. The fixed-opening diffuser (21) includes a diffuser housing (26) mounted to a support structure (25) and coupled to receive air from a supply conduit (24) positioned behind the support structure (25) and a diffusion assembly (27) mounted across the housing (26) to distribute the air from the housing (26). The method includes the steps of removing the diffusion assembly (27) from a position across the diffuser housing (26) to provide access to the housing, mounting a thermally-powered diffuser actuator assembly (31) having a movable vane (32) coupled to actuator assembly (31) inside the diffuser housing (26) in a position for control of air discharged from the diffuser housing (26) by thermally-driven displacement of the vane (32). Each of the steps of removing and mounting is accomplished while maintaining the diffuser housing (26) in place in the support structure (25) and while maintaining the support structure (25) in a substantially undisturbed state to minimize the release of dangerous materials possibly present in the support structure (25).

9 Claims, 5 Drawing Sheets

METHOD AND APPARATUS FOR CONVERTING A FIXED-OPENING AIR DIFFUSER TO AN INDIVIDUALLY-CONTROLLED VARIABLE AIR VOLUME DIFFUSER

TECHNICAL FIELD

This invention relates, in general, to heating and air conditioning air diffusers, and more particularly, relates to the conversion of fixed-opening air diffuser to variable air volume air diffusers.

BACKGROUND ART

Most heating and air conditioning systems employ one of two types of air diffusers, namely, fixed-opening air diffusers and variable-opening air diffusers. The variable-opening air diffusers are constructed in a manner which allows the volume of air discharged into the space to be heated or cooled to be varied or modulated. Thus, such diffusers are known as variable air volume or VAV diffusers.

Additionally, there are numerous types of controllers for VAV diffuser systems, including pneumatic, electrical and thermal sensor-actuator systems. Depending upon the controller, the movable vanes or elements varying air flow can be driven and controlled at each diffuser or at groups of diffusers.

VAV diffusers have the advantage over fixed-opening diffusers of greater control so that the heating and cooling can be better tailored to the demands of the various parts of a building in which the system is installed. Sun-facing rooms need more air conditioning in the summer and less heating in the winter. The heating and cooling requirements, moreover, change during the day as environmental conditions change surrounding the structure. VAV systems, therefore, tend to be more energy-efficient and provide more comfort control zones than fixed-opening systems.

Although not always the case, fixed-opening air diffusers often have lower initial cost than VAV diffuser systems. Accordingly, there are many older buildings, particularly older office buildings, that have fixed-opening diffuser heating and air conditioning systems. As energy-awareness has increased, it has become apparent that fixed-opening systems are energy inefficient and do not provide the required control features that a VAV diffuser system could provide. Many of these older office buildings, however, also have made wide-spread use of asbestos. Thus, the steel framework of older buildings often has a layer of asbestos over the steel to protect the framework from melt-down in a fire. Similarly, the original air conditioning duct work in older buildings may include asbestos flocking or tape as an insulator.

Broadly, it is well-known in the heating and air conditioning industry to change fixed-opening air diffusers to VAV air diffusers. This has been done by disconnecting the complete diffuser and replacing it with a new VAV diffuser. In electrical and pneumatic conversions, the necessary electrical or pneumatic wires and conduit also must be added to control diffuser operation. In drop-ceiling buildings, in which the air diffusers are mounted to a T-shaped support grid for the ceiling tiles, however, opening up the ceiling to replace an air diffuser can be relatively easily done, but it is very hazardous. While the ceiling tiles lift out of the grid rather easily, the top surfaces of the tiles and of the air diffuser housings can be covered with asbestos dust.

Accordingly, many old heating and cooling systems which employ fixed-opening air diffusers are candidates for conversion to VAV air diffuser systems, but the asbestos hazard makes such conversion dangerous and prohibitively expensive. Conversions in such buildings may require workers to wear protective clothing and use breathing apparatus, as well as require that the area be sealed during the replacement process. There are, therefore, many energy inefficient office buildings using fixed-opening air diffusers whose owners essentially cannot afford to convert to more efficient and comfortable heating and cooling systems.

Accordingly, it is an object of the present invention to provide a method and apparatus for converting fixed-opening air diffusers to individually-controlled VAV air diffusers substantially without disturbing the structure in which the fixed-opening air diffuser is mounted.

A further object of the present invention is to provide a method and apparatus for converting fixed-opening air diffusers to VAV air-diffusers which minimizes the exposure to dangerous or hazardous materials.

Another object of the present invention is to provide a method and apparatus for installing a variable air volume, individually-controlled air diffuser in a structure which possibly could have dangerous or hazardous materials in it without need for specially trained personnel and protective equipment.

The apparatus and method of the present invention have other objects and features of advantage which will become apparent from, or are set forth in more detail in, the following description of the Best Mode of Carrying Out the Invention and the accompanying drawing.

DISCLOSURE OF INVENTION

The method of converting a fixed-opening air diffuser to an individually-controlled variable air volume diffuser of the present invention includes the steps of removing the diffusion panel or louvers from a position across the fixed-opening air diffuser housing to provide access to the housing, mounting a thermally-powered diffuser actuator assembly having a movable vane coupled to the actuator assembly inside the diffuser housing in a position for control of air discharge from the diffuser housing by thermally-driven displacement of the vane, and accomplishing these steps while maintaining the diffuser housing in place in the support structure and while maintaining the support structure in a substantially undisturbed state to minimize the release of dangerous materials possibly present in the support structure. The mounting step preferably is accomplished by attaching the diffuser actuator assembly to one of the housing or the existing mounting posts for the diffusion panel.

The apparatus of the present invention is comprised, briefly, of a mounting bracket assembly formed to be attached to one of the existing mounting posts for the diffusion panel or the diffuser housing while the diffuser housing is in place in the support structure, a thermal sensor-actuator assembly carried by the mounting bracket assembly, and at least one vane coupled to the sensor-actuator assembly for displacement thereby to modulate the flow of air from the diffuser housing.

BEST MODE OF CARRYING OUT THE INVENTION

The method and apparatus of the present invention enable conversion of an existing heating and/or cooling air diffusion system from a fixed-opening system to one having variable air volume diffusers. This permits more energy efficient and comfortable heating and/or cooling of structures, and most importantly, the conversion method and apparatus of the present invention can be employed safely to convert fixed-opening diffuser systems to VAV systems without exposing the installers to possible hazardous or dangerous materials which may be present in the building ceiling structure. Thus, even in buildings known to have asbestos, the advantages of changing to a VAV heating and cooling system can be realized.

Figure 1A:
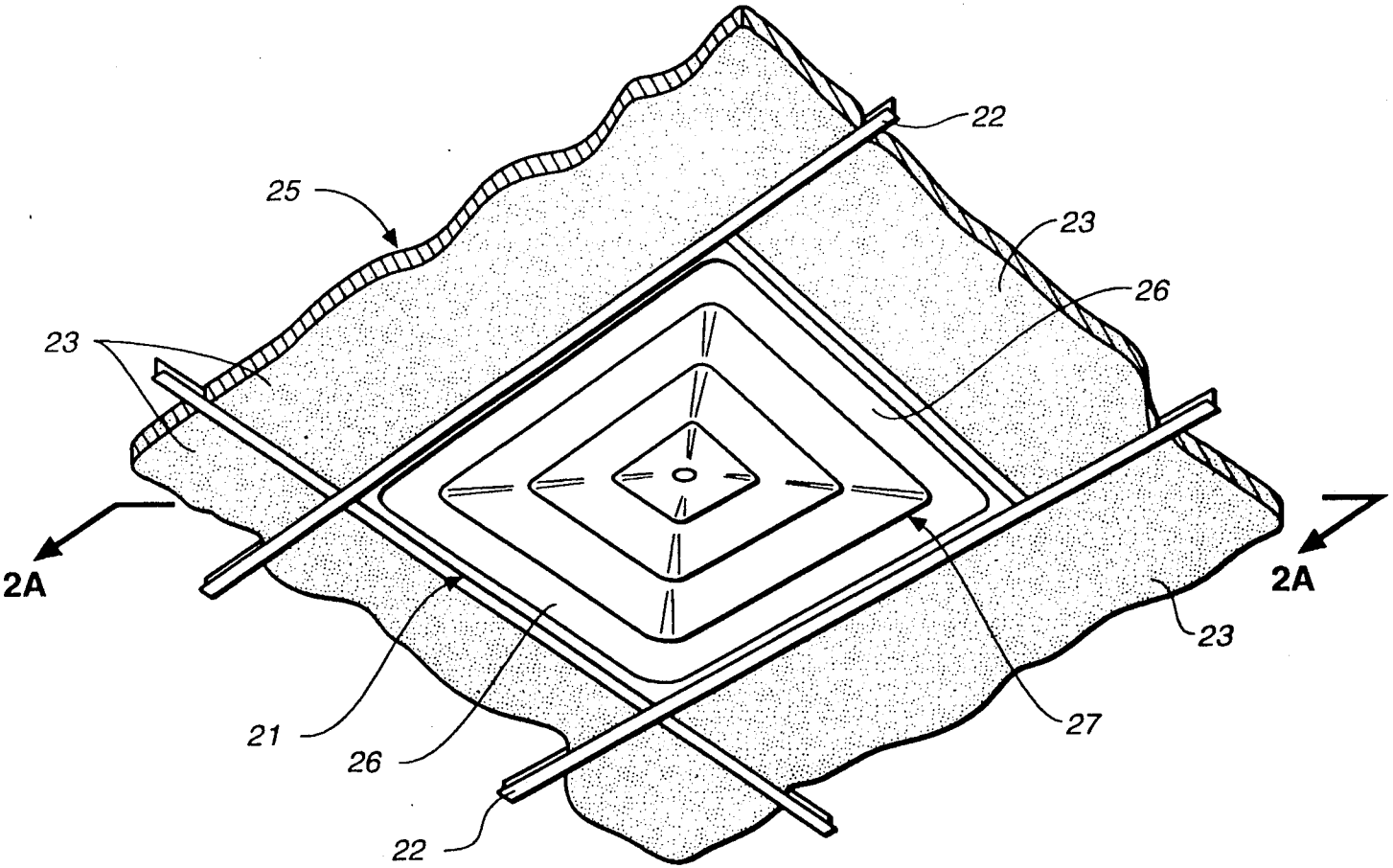
FIG. 1A (PRIOR ART)
FIG. 1A is a bottom perspective view of a fixed-opening air diffuser of the type known in the prior art employing the method according to the present invention.
Figure 2A:
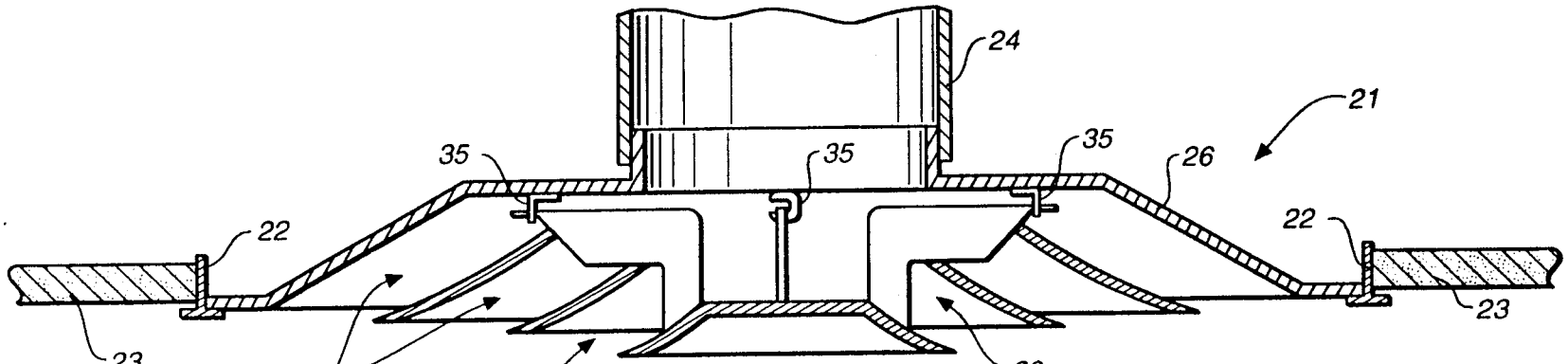
FIG. 2A (PRIOR ART)
FIG. 2A is a side elevation view in cross-section of the fixed-opening air diffuser of FIG. 1A, taken substantially along the plane of line 2A—2A.

Referring now to FIGS. 1A and 2A, a fixed-opening air diffuser, generally designated 21, is shown mounted in a ceiling support structure, generally designated 25, in this case a drop ceiling comprised of longitudinally-extending T-bars 22 and a plurality of ceiling tiles or panels 23 supported on the T-bars. In order to direct or diffuse the air from supply conduit 24 (FIG. 2A) in a relatively uniform pattern, diffuser assembly 21 is shown to have a housing 26 to which is mounted a louvered-faced diffusion assembly or means 27. The diffusion assembly 27 provides a plurality of short transverse pathways 30 that tend to distribute air along ceiling 25 in an attempt to take advantage of the Coanda effect. The Coanda effect is the attachment of discharged air to the ceiling as it moves transversely away from the diffuser and mixes with room air before it gradually descends. This is highly preferable as compared to dumping in which the air is descending downwardly directly out of the diffuser. The louver assembly 27 can have fixed individual louvers or angularly displaceable or adjustable louvers so as to control air flow. Adjustable louvers, however, once set, are not dynamically varied in a fixed-opening diffuser to modulate air flow.

Various alternative fixed-opening air diffusers 27 are well-known in the art, including perforated and unperforated transversely-extending plates (plaque diffusers), and diffusers using cones or baffles. The diffusion assembly 27 in most of such fixed-opening diffusers forces the air to discharge from diffuser 21 at an angle close to the plane of ceiling 25, as best seen in FIG. 2A, to attempt to take advantage of the Coanda effect. As thus far described, fixed-opening diffuser assembly 21 is constructed in a standard manner well-known in the industry.

With time, the upper surfaces of diffuser housing 26 and of ceiling tiles or panels 23 will become coated with dust, including hazardous materials such as asbestos, if the same are present in the building. Accordingly, lifting one tiles 23 off T-bars 22 will disturb this dust and very likely release the same into the room. Moreover, if one tries to remove diffuser housing 26 from air supply conduit 24, the installer is virtually certain to stir up considerable dust and debris, which would be extremely hazardous in buildings containing asbestos. Similarly, attempts to mount a VAV control box above the ceiling, or to replace supply conduit 24, or make any structural changes above the ceiling in order to convert the fixed-opening air diffuser to a VAV system cannot be safely accomplished in buildings with asbestos without special clothing, breathing apparatus and sealing off of the rooms involved.

The method and apparatus of the present invention, therefore, accomplish conversion to a VAV heating and/or cooling system by maintaining diffuser housing 26 in place in ceiling support structure 25 and by leaving the entire ceiling substantially undisturbed so as to minimize the release of dangerous materials possibly present in the ceiling support structure.

Figure 1B:
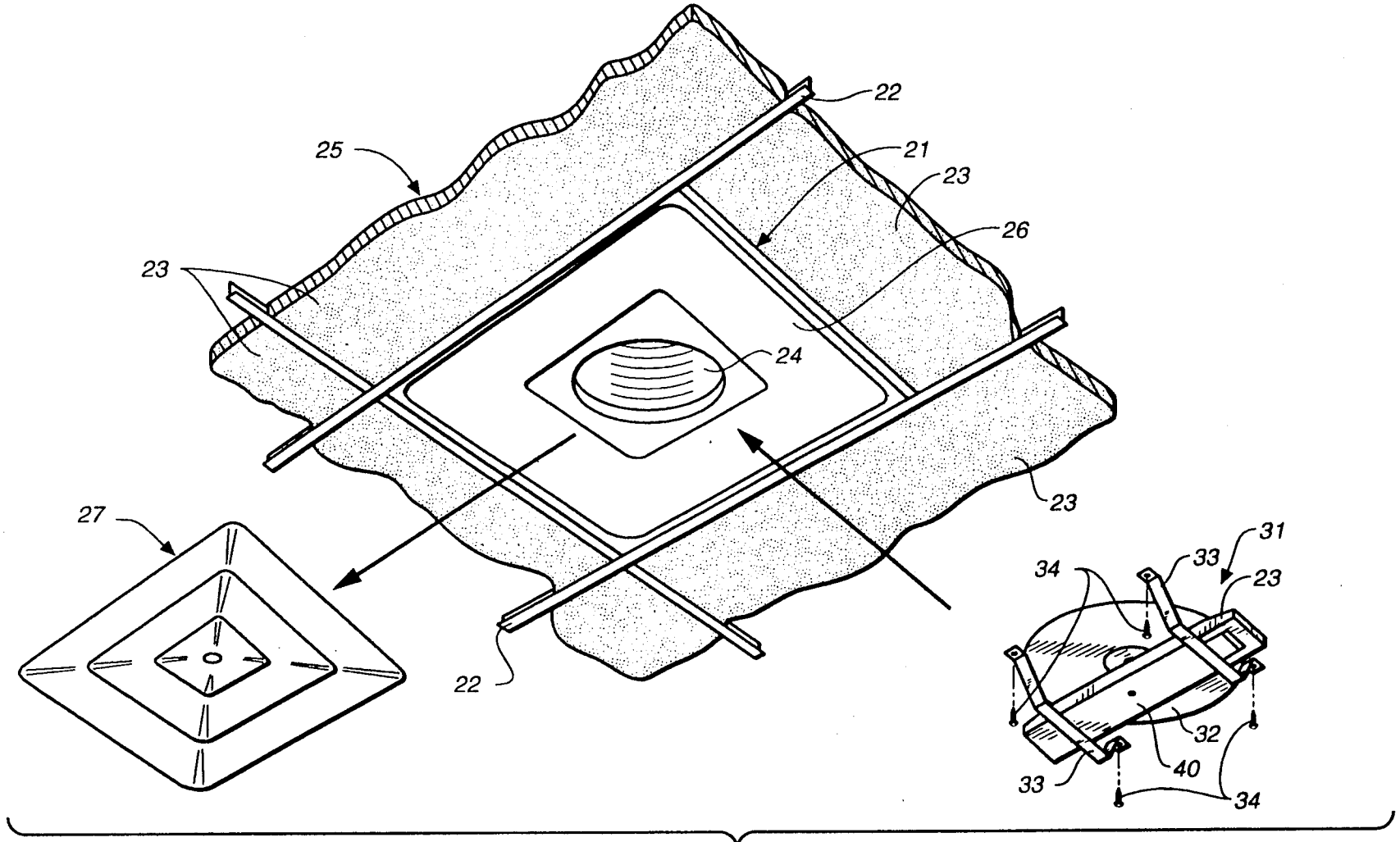
FIG. 1B is a bottom perspective view corresponding to FIG. 1A and illustrating steps in the fixed-opening to VAV diffuser conversion method of the present invention.
Figure 1C:
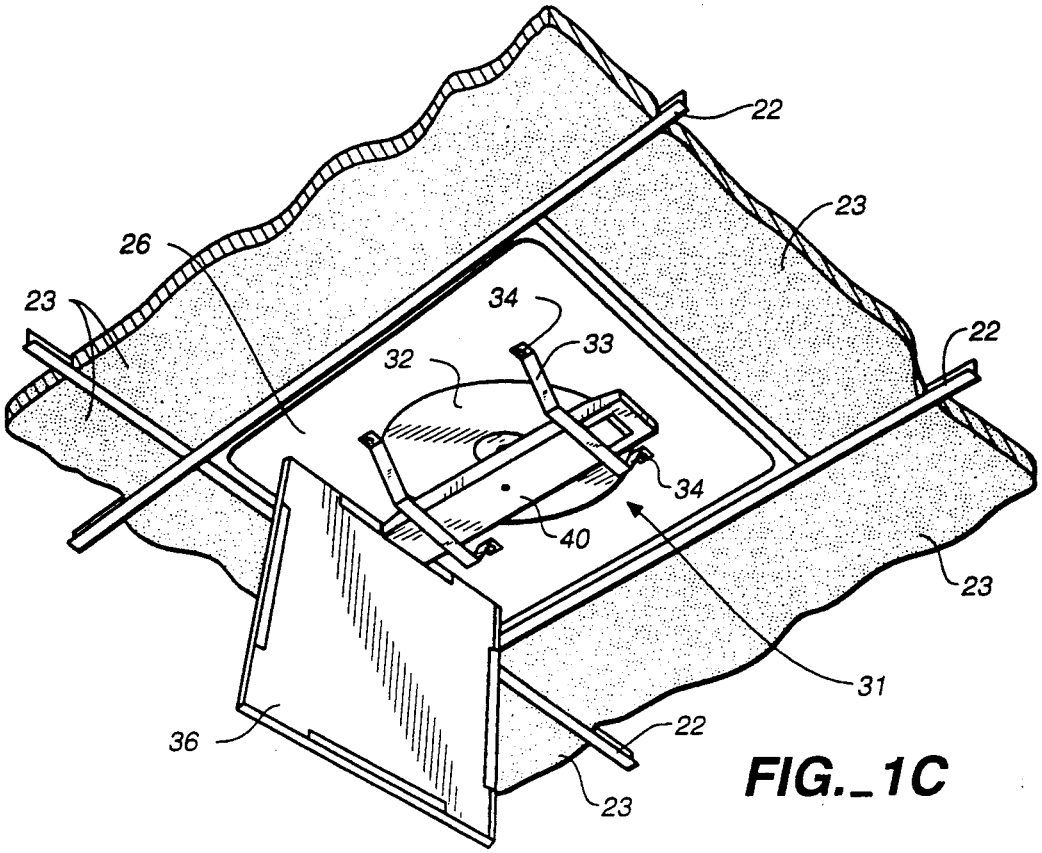
FIG. 1C is a bottom perspective view of the VAV actuator assembly mounted in the fixed-opening diffuser housing.

As best may be seen in FIG. 1B, this conversion method is accomplished by first removing diffusion assembly 27 from a position across diffuser housing 26 to provide access to the diffuser housing. In most cases, diffusion assembly 27 is completely removed from housing 26, usually by removing fasteners or detaching clips or brackets holding louver assembly 27 to housing 26. In FIG. 2A, diffusion assembly 27 can be seen to be mounted to housing 26 by clips 35, and assembly 27 can be unclipped from housing 26 by lifting and rotating assembly 27 slightly. In other installations, the mounting brackets for the diffusion assembly may have to be cut in order to remove assembly 27. Depending upon the mounting structure, it is possible to move assembly 27 by an amount sufficient to provide access simply by releasing one or more fasteners and pivoting the assembly out of the way to expose housing 26 without detaching assembly 27 from housing 26.

There are various approaches to powering movable vanes in VAV systems. Electrical and pneumatical approaches, however, are not well-suited to safe conversion of a fixed-opening air diffuser to a VAV diffuser because they tend to require wiring, conduits or other equipment be placed above the ceiling panels. Accordingly, once diffusion assembly 27 has been moved to a position providing access to housing 26, it is an important feature of the method of the present invention to include the step of mounting a thermally-powered, diffuser actuator assembly, generally designated 31 and shown in FIG. 1B, inside diffuser housing 26. Thermally-powered, diffuser actuator assembly 31 is coupled to a movable vane 32 shown in FIG. 1B as a disc. Assembly 31 includes at least one, and preferably a plurality, of thermal sensor-actuators. One sensor-actuator typically will be mounted inside an air induction housing 40 and will be coupled to work alone, or in combination with another sensor-actuator, so as to displace disc or vane 32 toward and away from housing 26 to thereby vary the opening between vane 32 and housing 26 and vary the air flow out of the housing. In the most preferred form, thermally-powered actuator assembly 31 will include a sensor-actuator positioned to sense the temperature of air in supply duct 24 and at least one second sensor-actuator positioned in housing 40 to sense the temperature of room air. Using these sensor-actuators, the supply air temperature and room air temperatures can be used to modulate or vary the air flow discharge from diffuser assembly 21.

Thermally-powered VAV diffuser assemblies and various linkages for coupling them to movable vanes are well-known in the industry and are described in more detail, for example, in U.S. Pat. Nos. Re. 30,953, 4,491,270, 4,509,678 and 4,523,713. Accordingly, they will not be described in detail, but are incorporated herein by reference. Such thermally-powered diffuser assemblies, however, have been employed as original heating and/or cooling air diffusers or have been used to replace fixed-opening diffusers by completely removing the fixed-opening diffuser housing from the ceiling support structure. In the conversion method of the present invention, however, only the actuator assembly and a movable vane portions of these thermally-powered diffusers is mounted into the fixed-opening diffuser housing. The conventional thermally-powered diffuser housing is not used.

As may be seen in FIG. 1B, thermally-powered diffuser assembly 31 is mounted or carried by special mounting brackets 33, which are formed to attach the actuator assembly directly to housing 26. The shape and size of mounting brackets 33 will be determined by the particular configuration of the fixed-opening housing. Many housings 26, however, have similar configurations.

In order to further ensure that hazardous material is not released during the conversion method of the present invention, it is preferable that brackets 33 be screwed into housing 26 by self-drilling, self-tapping screws 34. As the screws 34 penetrate housing 26, therefore, they prevent any asbestos or other hazardous dust from escaping outwardly of the diffuser housing into the room.

Figure 1D:
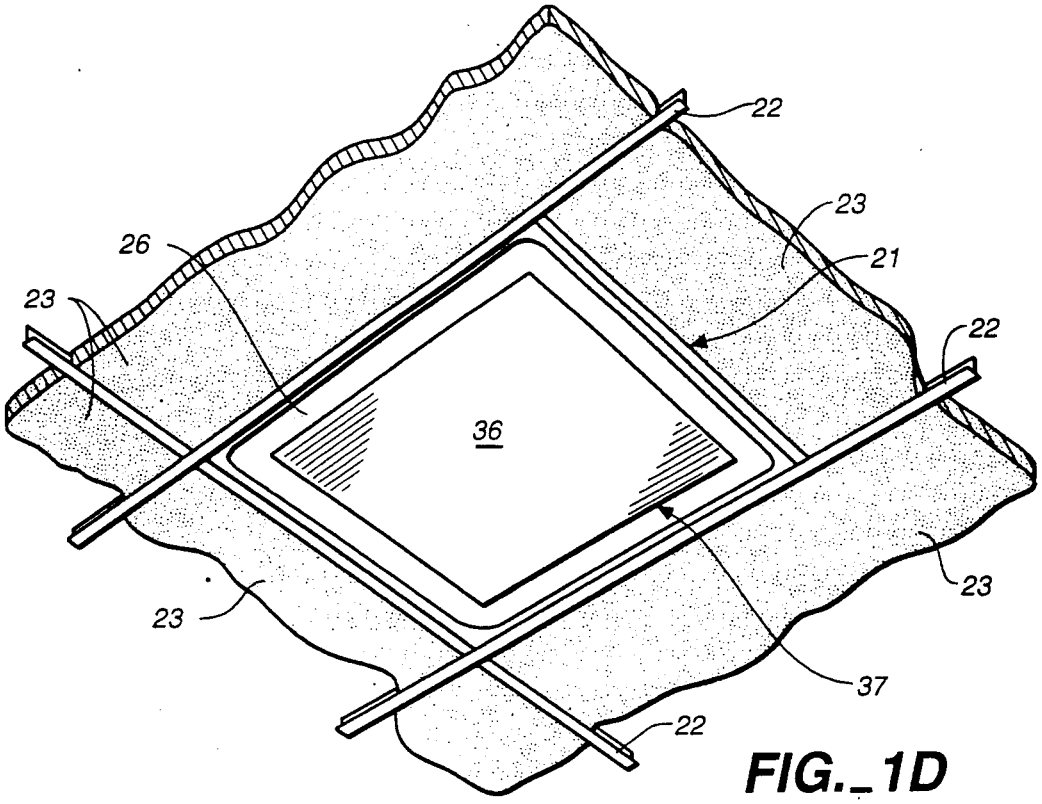
FIG. 1D is a bottom perspective view of the resulting conversion with an apparatus panel mounted across the diffuser housing.

Since control of air flow from diffuser 21 may now be determined by assembly 31 and movement of vane 32 relative to housing 26, and since vane 32 will produce flow along the ceiling structure to take advantage of the Coanda effect, one would not have to mount a diffusion panel over the thermally-powered actuator assembly 31 in order to have diffuser 21 function properly. In most cases, however, it is preferable to mount an appearance panel 36 across diffuser housing 26 exteriorly of the actuator assembly 31. The appearance panel extends proximate to, but does close, the periphery of housing 26 so that air will escape from the rectangular peripheral opening 37 shown in FIG. 1D, which illustrates the appearance of diffuser assembly 21 after being converted to a VAV, thermally-powered diffuser using the method and apparatus of the present invention.

Instead of a mere appearance panel, the panel secured across housing 26 can also have a diffusion function, that is, it can cooperate with a movable vane to assist in the diffusion of air as it flows from housing 26.

Figure 2B:
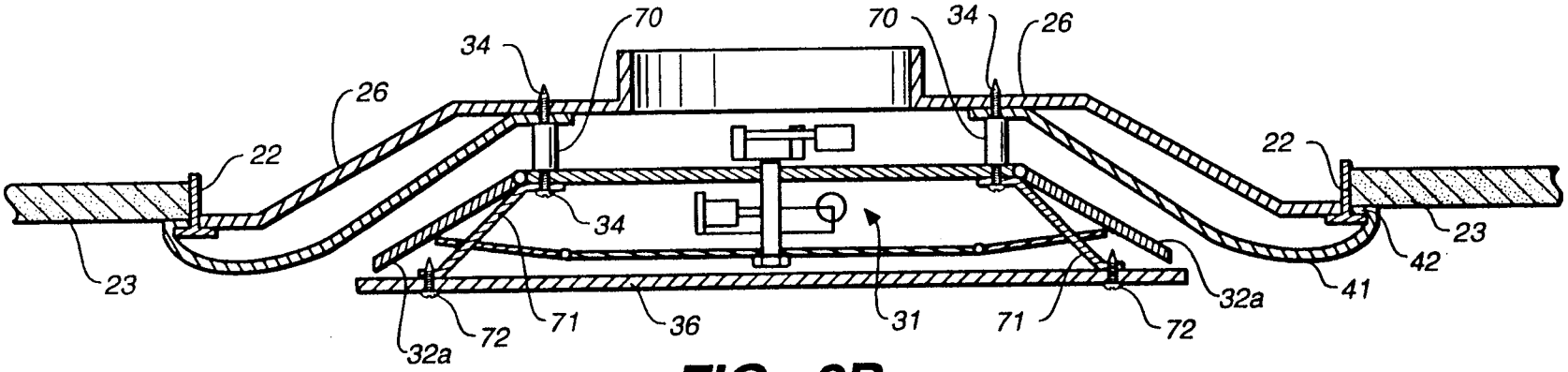
FIG. 2B is a side elevation, schematic view of the fixed-opening air diffuser after conversion to a VAV air diffuser using a diffuser housing insert.

In some installations, diffuser housing 26 will have a configuration which makes it relatively unsuitable for cooperation with a movable vane in order to control the volume of air flow discharge from the diffuser. In FIG. 2B, for example, this problem is accommodated by mounting an insert or adaptation 41 in diffuser housing 26 before the step of mounting thermal actuator assembly 31 to the housing. For example, one end 42 of insert 41 can go over T-bar 22 and under ceiling panel 23, while the other end is fastened, for example, by self-drilling, self-tapping screws 34 and spacers or stand-offs 70 to housing 26. The appearance panel 36 is secured by fasteners 72 or detent mounts (not shown) to brackets 71. The insert surface will be formed to be engaged by movable vanes 32a, which pivot up against adaptation 41 as driven by actuator assembly 31.

Figure 3:
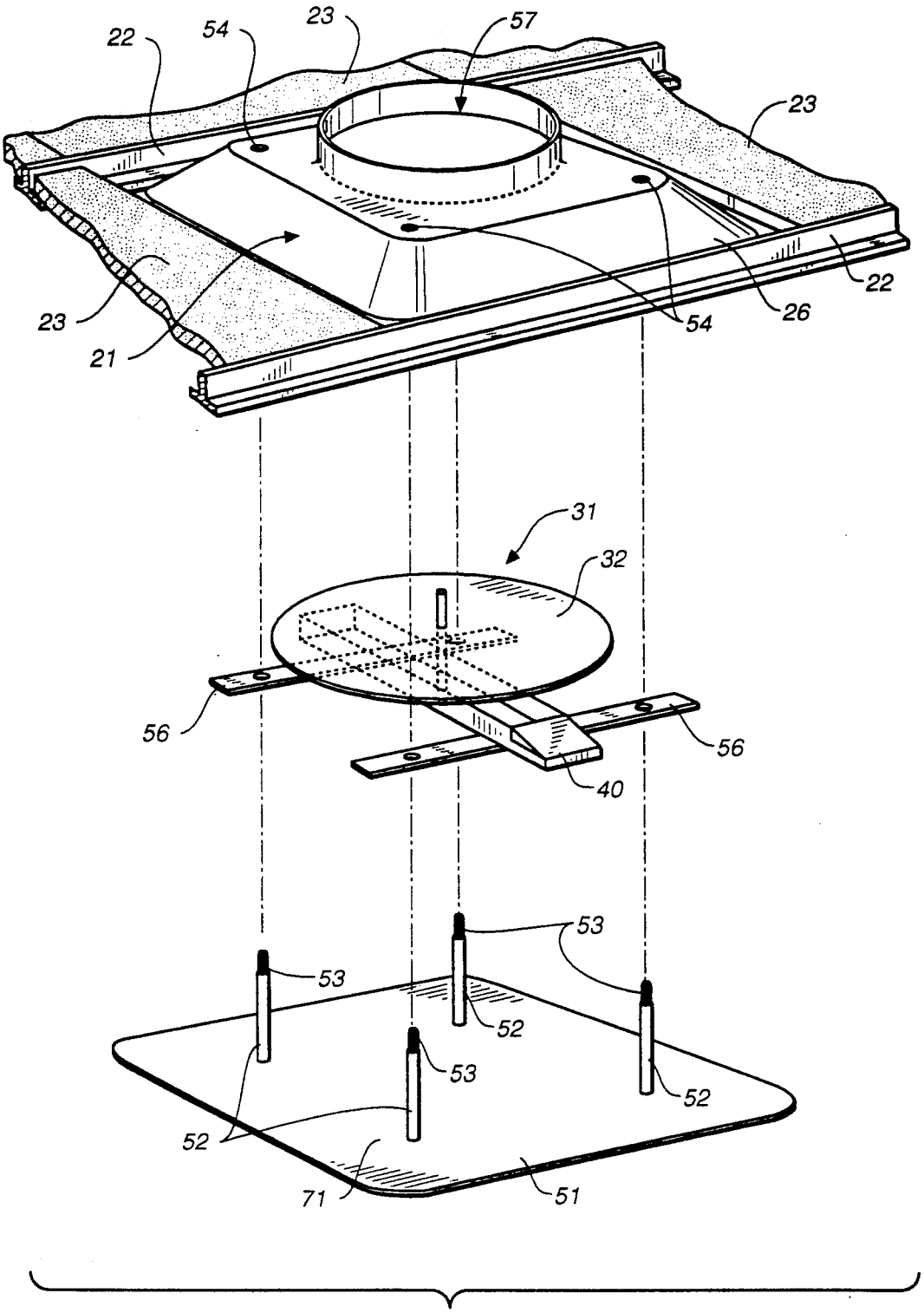
FIG. 3 is an exploded, top perspective, schematic view of an alternative embodiment of a fixed volume air diffuser and conversion assembly constructed in accordance with the present invention.

In FIG. 3, the step of mounting thermally-powered actuator assembly 31 in housing 26 is accomplished by supporting actuator 31 on an appearance or diffusion panel 51 and thereafter securing the panel 51 to housing 26. In the form of fixed-opening air diffuser 21 shown in FIG. 3, appearance panel 51 is mounted by mounting posts 52 and by enlarged ends 53 which are releasably gripped by fastener-receiving resilient clips 54 in diffuser housing 26. Actuator assembly 31 can be provided with mounting brackets or arms 56 having openings 57 dimensioned to pass over posts ends 53 so that assembly 31 can rest on panel 51.

In this form of the present method and apparatus, therefore, the original appearance panel 51 is removed, assembly 31 is mounted on mounting posts 52 to support thermally-powered actuator assembly 31 on appearance panel 51, and finally, the appearance panel is remounted to housing 26 by mounting post 52. As will be apparent, assembly 31 must be dimensioned to fit between panel 51 and housing 26 and movable disc or vane 32 dimensioned to extend across housing inlet opening 57.

In the method and apparatus of the present invention, therefore, the thermally-powered actuator assembly can be mounted in housing 26 by attachment directly or indirectly to the housing. It will be understood that, in a manner similar to ends 42 of adaptation 41 of FIG. 2A, mounting brackets for the actuator assembly could also extend to and mount under ceiling tiles 23 on the T-shaped ceiling support bars without substantially disturbing the ceiling structure. This latter version is less desirable in that the mounting brackets are more likely to be visible.

What is claimed is:

1. A method of converting a fixed-opening air diffuser to an individually-controlled variable air volume diffuser, said fixed-opening air diffuser including a diffuser housing mounted to a support structure and coupled to receive air from a supply conduit positioned behind said support structure, and a diffusion assembly mounted across said diffuser housing, said method including the steps of:

removing said diffusion assembly from a position across said diffuser housing to provide access to said diffuser housing;

mounting a thermally-powered diffuser actuator assembly having a movable vane coupled to said actuator assembly inside said diffuser housing in a position for control of air discharged from said diffuser housing by thermally-driven displacement of said vane; and each of said steps being accomplished while maintaining said diffuser housing in place in said support structure and while maintaining said support structure in a substantially undisturbed state to minimize the release of dangerous materials possibly present in said support structure.

2. The method as defined in claim 1, and after said mounting step, securing one of an appearance panel and a diffusion panel across said diffuser housing exteriorly of said actuator assembly.

3. The method as defined in claim 1 wherein, said mounting step is accomplished by supporting said actuator assembly on one of an appearance panel and a diffusion panel and securing said one of said appearance panel and said diffusion panel across said diffuser housing.

4. The method as defined in claim 1 wherein, said mounting step is accomplished by securing said assembly to said diffuser housing.

5. The method as defined in claim 4 wherein, said securing step is accomplished by securing said actuator assembly to said housing by self-drilling, self-tapping screws.

6. The method as defined in claim 4 and the step of prior to said mounting step, attaching an insert to said housing, said insert being formed to cooperate with said vane in modulating the flow of air from said diffuser, said attaching step being accomplished substantially without disturbing said support structure.

7. The method as defined in claim 1 wherein, said mounting step is accomplished by mounting said actuator assembly to said diffusion assembly and remounting said diffusing assembly to said diffuser housing.

8. The method as defined in claim 7 wherein, said actuator assembly is mounted to mounting posts for said diffusion assembly.

9. The method as defined in claim 1 wherein, said actuator assembly includes a plurality of thermal sensor-actuators mounted and coupled to said vane to modulate the flow of air from said diffuser housing based upon sensing of at least one of supply air temperature and room air temperature.

* * * * *